US007027980B2

(12) United States Patent
Ramabadran et al.

(10) Patent No.: US 7,027,980 B2
(45) Date of Patent: Apr. 11, 2006

(54) METHOD FOR MODELING SPEECH HARMONIC MAGNITUDES

(75) Inventors: Tenkasi V. Ramabadran, Naperville, IL (US); Aaron M. Smith, Streamwood, IL (US); Mark A. Jasiuk, Chicago, IL (US)

(73) Assignee: Motorola, Inc., Schaumburg, IL (US)

( * ) Notice: Subject to any disclaimer, the term of this patent is extended or adjusted under 35 U.S.C. 154(b) by 707 days.

(21) Appl. No.: 10/109,151

(22) Filed: Mar. 28, 2002

(65) Prior Publication Data

US 2003/0187635 A1 Oct. 2, 2003

(51) Int. Cl.
*G10L 19/00* (2006.01)
*G10L 19/04* (2006.01)

(52) U.S. Cl. ..... 704/217; 704/216; 704/219

(58) Field of Classification Search ..... 704/217, 704/216, 219

See application file for complete search history.

(56) References Cited

U.S. PATENT DOCUMENTS

| | | | | |
|---|---|---|---|---|
| 4,771,465 | A | 9/1988 | Bronson et al. | |
| 5,081,681 | A * | 1/1992 | Hardwick et al. | 704/268 |
| 5,226,084 | A * | 7/1993 | Hardwick et al. | 704/219 |
| 5,630,011 | A | 5/1997 | Lim et al. | |
| 5,717,821 | A * | 2/1998 | Tsutsui et al. | 704/200.1 |
| 5,832,437 | A | 11/1998 | Nishiguchi et al. | |
| 5,890,108 | A * | 3/1999 | Yeldener | 704/208 |
| 6,098,037 | A | 8/2000 | Yeldener | |
| 6,370,500 | B1 * | 4/2002 | Huang et al. | 704/208 |

OTHER PUBLICATIONS

Huijuan Cui, Research On MBE Algorithm At Bit Rate 800 BPS—2.4 KBPS Vocoder, International Conference on Communicatoin Technology, Oct. 22-24, 1998, pp. S36-09-1-S36-09-4.*

Griffen et al, Multiband Excitation Vocoder, Aug. 1988, IEEE Trans. on Acoustics, Speech, and Signal Processing, vol. 36, No. 8, pp. 1223-1235.*

Choi, Yong-Soo, and Dae-Hee Youn. "Fast Harmonic Estimation Method for Harmonic Speech Coders." Electronic Letters, Mar. 28, 2002, v. 38, n. 7, pp. 346-347.

* cited by examiner

*Primary Examiner*—Richemond Dorvil
*Assistant Examiner*—Thomas E. Shortledge
(74) *Attorney, Agent, or Firm*—Sylvia Chen

(57) ABSTRACT

A system or method for modeling a signal, such as a speech signal, in which harmonic frequencies and amplitudes are identified and the harmonic magnitudes are interpolated to obtain spectral magnitudes at a set of fixed frequencies. An inverse transform is applied to the spectral magnitudes to obtain a pseudo auto-correlation sequence, from which linear prediction coefficients are calculated. From the linear prediction coefficients, model harmonic magnitudes are generated by sampling the spectral envelope defined by the linear prediction coefficients. A set of scale factors are then calculated as the ratio of the harmonic magnitudes to the model harmonic magnitudes and interpolated to obtain a second set of scale factors at the set of fixed frequencies. The spectral envelope magnitudes at the set of fixed frequencies are multiplied by the second set of scale factors to obtain new spectral magnitudes and the process is iterated to obtain final linear prediction coefficients. The signal is modeled by the linear prediction coefficients.

39 Claims, 4 Drawing Sheets

METHOD FOR MODELING SPEECH HARMONIC MAGNITUDES

FIELD OF THE INVENTION

This invention relates to techniques for parametric coding or compression of speech signals and, in particular, to techniques for modeling speech harmonic magnitudes.

BACKGROUND OF THE INVENTION

In many parametric vocoders, such as Sinusoidal Vocoders and Multi-Band Excitation Vocoders, the magnitudes of speech harmonics form an important parameter set from which speech is synthesized. In the case of voiced speech, these are the magnitudes of the pitch frequency harmonics. In the case of unvoiced speech, these are typically the magnitudes of the harmonics of a very low frequency (less than or equal to the lowest pitch frequency). For mixed-voiced speech, these are the magnitudes of the pitch harmonics in the low-frequency band and the harmonics of a very low frequency in the high-frequency band.

Efficient and accurate representation of the harmonic magnitudes is important for ensuring high speech quality in parametric vocoders. Because the pitch frequency changes from person to person and even for the same person depending on the utterance, the number of harmonics required to represent speech is variable. Assuming a speech bandwidth of 3.7 kHz, a sampling frequency of 8 kHz, and a pitch frequency range of 57 Hz to 420 Hz (pitch period range: 19 to 139), the number of speech harmonics can range from 8 to 64. This variable number of harmonic magnitudes makes their representation quite challenging.

A number of techniques have been developed for the efficient representation of the speech harmonic magnitudes. They can be broadly classified into a) Direct quantization, and b) Indirect quantization through a model. In direct quantization, scalar or vector quantization (VQ) techniques are used to quantize the harmonic magnitudes directly. An example is the Non-Square Transform VQ technique described in "Non-Square Transform Vector Quantization for Low-Rate Speech Coding", P. Lupini and V. Cuperman, Proceedings of the 1995 IEEE Workshop on Speech Coding for Telecommunications, pp. 87–88, September 1995. In this technique, the variable dimension harmonic (log) magnitude vector is transformed into a fixed dimension vector, vector quantized, and transformed back into a variable dimension vector. Another example is the Variable Dimension VQ or VDVQ technique described in "Variable-Dimension Vector Quantization of Speech Spectra for Low-Rate Vocoders", A. Das, A. Rao, and A. Gersho, Proceedings of the IEEE Data Compression Conference, pp. 420–429, April 1994. In this technique, the VQ codebook consists of high-resolution code vectors with dimension at least equal to the largest dimension of the (log) magnitude vectors to be quantized. For any given dimension, the code vectors are first subsampled to the right dimension and then used to quantize the (log) magnitude vector.

In indirect quantization, the harmonic magnitudes are first modeled by another set of parameters, and these model parameters are then quantized. An example of this approach can be found in the IMBE vocoder described in "APCO Project 25 Vocoder Description", TIA/EIA Interim Standard, July 1993. The (log) magnitudes of the harmonics of a frame of speech are first predicted by the quantized (log) magnitudes corresponding to the previous frame. The (prediction) error magnitudes are next divided into six groups, and each group is transformed by a DCT (Discrete Cosine Transform). The first (or DC) coefficient of each group is combined together and transformed again by another DCT. The coefficients of this second DCT as well as the higher order coefficients of the first six DCTs are then scalar quantized. Depending on the number of harmonic magnitudes, the group size as well as the bits allocated to individual DCT coefficients is changed, keeping the total number of bits constant. Another example can be found in the Sinusoidal Transform Vocoder described in "Low-Rate Speech Coding Based on the Sinusoidal Model", R. J. McAulay and T. F. Quatieri, Advances in Speech Signal Processing, Eds. S. Furui and M. M. Sondhi, pp. 165–208, Marcel Dekker Inc., 1992. First, an envelope of the harmonic magnitudes is obtained and a (Mel-warped) Cepstrum of this envelope is computed. Next, the cepstral representation is truncated (say, to M values) and transformed back to frequency domain using a Cosine transform. The M frequency domain values (called channel gains) are then quantized using DPCM (Differential Pulse Code Modulation) techniques.

A popular model for representing the speech spectral envelope is the all-pole model, which is typically estimated using linear prediction methods. It is known in the literature that the sampling of the spectral envelope by the pitch frequency harmonics introduces a bias in the model parameter estimation. A number of techniques have been developed to minimize this estimation error. An example of such techniques is Discrete All-Pole Modeling (DAP) as described in "Discrete All-Pole Modeling", A. El-Jaroudi and J. Makhoul, IEEE Trans. on Signal Processing, Vol. 39, No. 2, pp. 411–423, February 1991. Given a discrete set of spectral samples (or harmonic magnitudes), this technique uses an improved auto-correlation matching condition to come up with the all-pole model parameters through an iterative procedure. Another example is the Envelope Interpolation Linear Predictive (EILP) technique presented in "Spectral Envelope Sampling and Interpolation in Linear Predictive Analysis of Speech", H. Hermansky, H. Fujisaki, and Y. Sato, Proceedings of the IEEE International Conference on Acoustics, Speech, and Signal Processing, pp. 2.2.1–2.2.4, March 1984. In this technique, the harmonic magnitudes are first interpolated using an averaged parabolic interpolation method. Next, an Inverse Discrete Fourier Transform is used to transform the (interpolated) power spectral envelope to an auto-correlation sequence. The all-pole model parameters viz., predictor coefficients, are then computed using a standard LP method, such as Levinson-Durbin recursion.

BRIEF DESCRIPTION OF THE DRAWINGS

The novel features believed characteristic of the invention are set forth in the claims. The invention itself, however, as well as the preferred mode of use, and further objects and advantages thereof, will best be understood by reference to the following detailed description of an illustrative embodiment when read in conjunction with the accompanying drawing(s), wherein:

DESCRIPTION OF THE INVENTION

Figure 1:
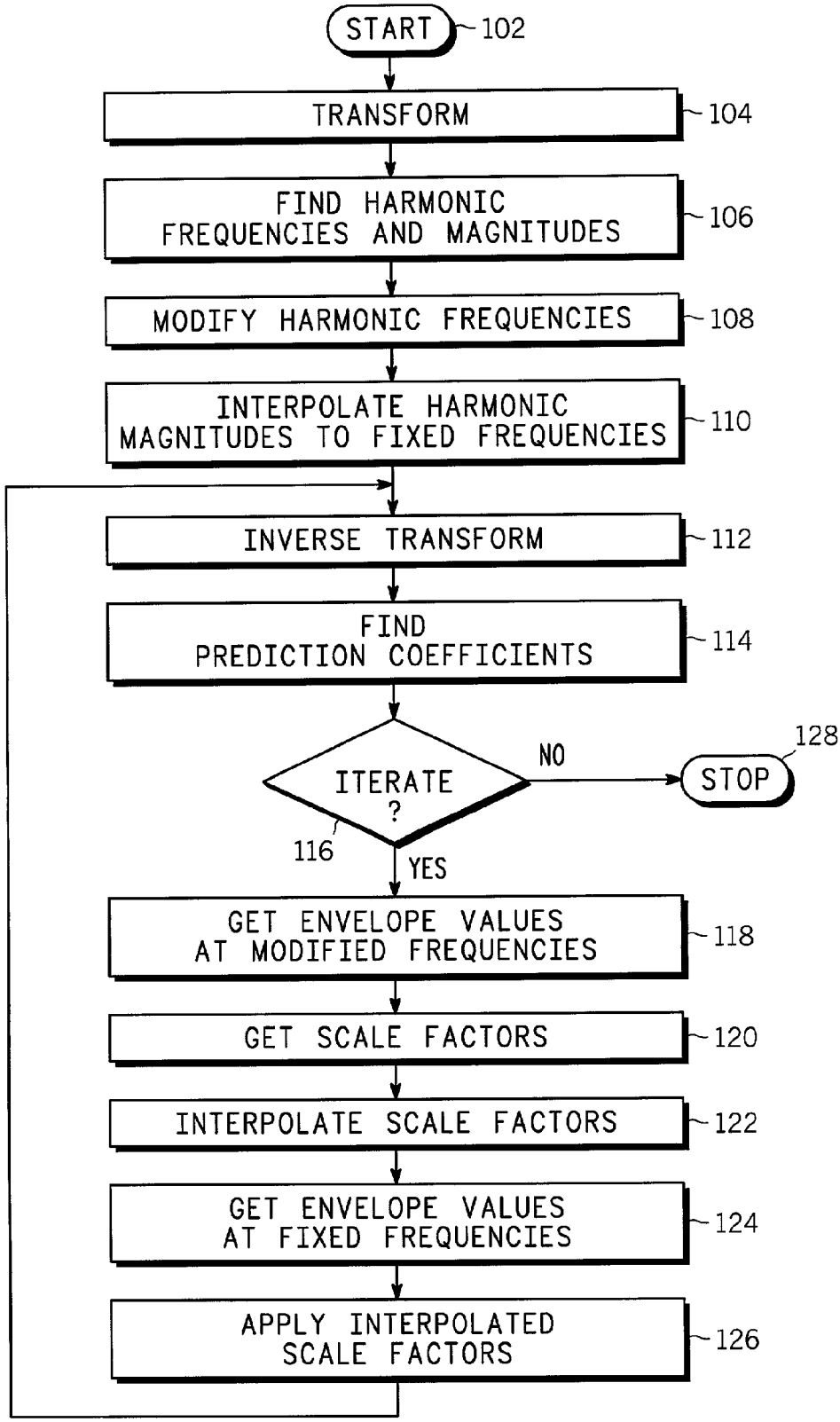
FIG. 1 is a flow chart of a preferred embodiment of a method for modeling speech harmonic magnitudes in accordance with the present invention.

While this invention is susceptible of embodiment in many different forms, there is shown in the drawings and will herein be described in detail one or more specific embodiments, with the understanding that the present disclosure is to be considered as exemplary of the principles of the invention and not intended to limit the invention to the specific embodiments shown and described. In the description below, like reference numerals are used to describe the same, similar or corresponding parts in the several Views of the drawings.

The present invention provides an all-pole modeling method for representing speech harmonic magnitudes. The method uses an iterative procedure to improve modeling accuracy compared to prior techniques. The method of the invention is referred to as an Iterative, Interpolative, Transform (or IIT) method.

FIG. 1 is a flow chart of a preferred embodiment of a method for modeling speech harmonic magnitudes in accordance with an embodiment of the present invention. Following start block 102, a frame of speech samples is transformed at block 104 to obtain the spectrum of the speech frame. The pitch frequency and harmonic magnitudes to be modeled are found at block 106. The K harmonic magnitudes are denoted by $\{M_1, M_2, \ldots, M_K\}$. Clearly, $M_k>=0$ for k=1, 2, . . . , K. Similarly, the harmonic frequencies are denoted by $\{\omega_1, \omega_2, \ldots, \omega_K\}$. Typically, the harmonic frequencies are multiples of the pitch frequency $\omega_1$ for voiced speech, i.e., $\omega_k=k * \omega_1$ for k=1, 2, . . . , K, but the method itself can accommodate any arbitrary set of frequencies. For transformation purposes, a set of fixed frequencies $\{i * \pi/N\}$ is defined for i=0, 1, . . . , N. The value of N is chosen to be large enough to capture the spectral envelope information contained in the harmonic magnitudes and to provide adequate sampling resolution, viz., $\pi/N$, to the spectral envelope. For example, if the number of harmonics K ranges from 8 to 64, N may be chosen as 64. Before being input to the algorithm, the harmonic frequencies are modified at block 108. The modified harmonic frequencies are denoted by $\{\theta_1, \theta_2, \ldots, \theta_K\}$ which are calculated according to the linear interpolation formula $$\theta_k=\pi/N+[(\omega_k-\omega_1)/(\omega_K-\omega_1)]*[(N-2)*\pi/N],\quad k=1, 2, 3, \ldots, K.$$

In this manner, $\omega_1$ is mapped to $\pi/N$, and $\omega_K$ is mapped to $(N-1)*\pi/N$. In other words, the harmonic frequencies in the range from $\omega_1$ to $\omega_K$ are modified to cover the range from $\pi/N$ to $(N-1)*\pi/N$. The above mapping of the original harmonic frequencies to modified harmonic frequencies ensures that all of the fixed frequencies other than the D.C. (0) and folding ($\pi$) frequencies can be found by interpolation. Other mappings may be used. In a further embodiment, no mapping is used, and the spectral magnitudes at the fixed frequencies are found by interpolation or extrapolation from the original, i.e., unmodified harmonic frequencies.

At block 110 the spectral magnitude values at the fixed frequencies are computed through interpolation (and extrapolation if necessary) of the known harmonic magnitudes. The spectral magnitudes at the fixed frequencies are denoted by $\{P_0, P_1, \ldots, P_N\}$ corresponding to the frequencies $\{i*\pi/N\}$ for i=0, 1, . . . , N. Clearly, the magnitudes $P_1$ and $P_{N-1}$ are given by $M_1$ and $M_K$ respectively. The magnitudes at the fixed frequencies $i*\pi/N$, i=2, 3, . . . , N−2 are computed through interpolation of the known values at the modified harmonic frequencies. For example, if $i*\pi/N$ falls between $\theta_k$ and $\theta_{k+1}$, the magnitude at the $i^{th}$ fixed frequency is given by $$P_i=M_k+[((i*\pi/N)-\theta_k)/(\theta_{k+1}-\theta_k)]*(M_{k+1}-M_k).$$

Here, linear interpolation has been used, but other types of interpolation may be used without departing from the invention. The magnitudes $P_0$ and $P_N$ at frequencies 0 and $\pi$ are computed through extrapolation. One simple method is to set $P_0$ equal to $P_1$ and $P_N$ equal to $P_{N-1}$. Another method is to use linear extrapolation. Using $P_1$ and $P_2$ to compute $P_0$, gives $P_0=2*P_1-P_2$. Similarly, using $P_{N-2}$ and $P_{N-1}$ to compute $P_N$, we get $P_N=2*P_{N-1}-P_{N-2}$. Of course, $P_0$ and $P_N$ are also constrained to be greater than or equal to zero. In the embodiment described above for blocks 108 and 110, the value of N is fixed for different K and there is no guarantee that the harmonic magnitudes other than $M_1$ and $M_K$ will be part of the set of magnitudes at the fixed frequencies, viz., $\{P_0, P_1, \ldots, P_N\}$. In another embodiment, the value of N is made a function of K, viz., N=(K−1)*I+2, where I>=1 is called the interpolation factor. With this value of N, when the harmonic frequencies are modified according to the linear interpolation formula $$\theta_k=\pi/N+[(\omega_k-\omega_1)/(\omega_K-\omega_1)]*[(N-2)*\pi/N],\quad k=1, 2, 3, \ldots, K.$$

in block 108, $\omega_1$, is mapped to $\pi/N$, $\omega_2$ is mapped to $(I+1)*\pi/N$, $\omega_3$is mapped to $(2*I+1)*\pi/N$, and so on until $\omega_K$ is mapped to $((K-1)*I+1)*\pi/N=(N-1)*\pi/N$. Thus the modified frequencies $\{\theta_1, \theta_2, \ldots, \theta_K\}$ form a subset of the fixed frequencies $\{i*\pi/N\}$, i=1, 2, . . . , N. Correspondingly, in block 110, when the spectral magnitude values at the fixed frequencies are computed, the harmonic magnitudes $\{M_1, M_2, \ldots, M_K\}$ form a subset of the spectral magnitudes at the fixed frequencies, viz., $\{P_0, P_1, \ldots, P_N\}$. In the preferred embodiment, the value of the interpolation factor I is chosen to be 4 for (K<12), 3 for (12<=K<16), 2 for (16<=K<24), and 1 for (K>=24).

At block 112 an inverse transform is applied to the magnitude values at the fixed frequencies to obtain a (pseudo) auto-correlation sequence. Given the magnitudes at the fixed frequencies $\{i*\pi/N\}$, i=0, 1, . . . , N, a 2N-point inverse DFT (Discrete Fourier Transform) is used to compute an auto-correlation sequence assuming that the frequency domain sequence is even, i.e., $P_{-i}=P_i$. Since the frequency domain sequence is real and even, the corresponding time domain sequence is also real and even, as it should be for an auto-correlation sequence. However, it should be noted that the frequency domain values in the preferred embodiment are magnitudes rather than power (or energy) values, and therefore the time domain sequence is not a real auto-correlation sequence. It is therefore referred to as a pseudo auto-correlation sequence. The magnitude spectrum is the square root of the power spectrum and is flatter. In a further embodiment, a log-magnitude spectrum is used, and in a still further embodiment the magnitude spectrum may be raised to an exponent other than 1.0.

If N is a power of 2, a FFT (Fast Fourier Transform) algorithm may be used to compute the 2N-point inverse DFT. However, only the first J+1 auto-correlation values are required, where J is the predictor (or model) order. Depending on the value of J, a direct computation of the inverse DFT may be more efficient than an FFT. Let $\{R_0, R_1, \ldots,$ $R_J\}$ denote the first J+1 values of the pseudo auto-correlation sequence. Then, $R_j$ is given by $$R_j = P_0 + (-1)^j * P_N + 2 * \sum_{i=1}^{i=N-1} Pi * \cos(i * j * \pi / N).$$

At block 114 predictor coefficients $\{a_1, a_2, \ldots, a_J\}$ are calculated from the J+1 pseudo auto-correlation values. The predictor coefficients $\{a_1, a_2, \ldots, a_J\}$ are computed as the solution of the normal equations $$\sum_{j=1}^{j=J} a_j * R(i-j) = R_i \text{ for } i = 1, 2, \ldots, J.$$

In the preferred embodiment, Levinson-Durbin recursion is used to solve these equations, as described in "Discrete-Time Processing of Speech Signals", J. R. Deller, Jr., J. G. Proakis, and J. H. L. Hansen, Macmillan, 1993.

At decision block 116 a check is made to determine if more iteration is required. If not, as depicted by the negative branch from decision block 116, the method terminates at block 128. The predictor coefficients $\{a_1, a_2, \ldots, a_J\}$ parameterize the harmonic magnitudes. The coefficients may be coded by known coding techniques to form a compact representation of the harmonic magnitudes. In the preferred embodiment, a voicing class, the pitch frequency, and a gain value are used to complete the description of the speech frame.

If further iteration is required, as depicted by the positive branch from decision block 116, the spectral envelope defined by the predictor coefficients is sampled at block 118 to obtain the modeled magnitudes at the modified harmonic frequencies. Let $A(z)=1+a_1z^{-1}+a_2z^{-2}+\ldots+a_Jz^{-J}$ denote the prediction error filter, where z is the standard Z-transform variable. The spectral envelope at frequency ω is then given (accurate to a gain constant) by $1.0/|A(z)|^2$ with $z=e^{j\omega}$. To obtain the modeled magnitudes at the modified harmonic frequencies $\theta_k$, k=1, 2, . . . , K, the spectral envelope is sampled at these frequencies. The resulting magnitudes are denoted by $\{\underline{M}_1, \underline{M}_2, \ldots, \underline{M}_K\}$.

If the frequency domain values that were used to obtain the pseudo auto-correlation sequence are not harmonic magnitudes but some function of the magnitudes, additional operations are necessary to obtain the modeled magnitudes. For example, if log-magnitude values were used, then an anti-log operation is necessary to obtain the modeled magnitudes after sampling the spectral envelope.

At block 120 scale factors are computed at the modified harmonic frequencies so as to match the modeled magnitudes and the known harmonic magnitudes at these frequencies. Before computing the scale factors, it is necessary to ensure that the known magnitudes and the modeled magnitudes at the modified harmonic frequencies are normalized in some suitable manner. A simple approach is to use energy normalization, i.e., $\Sigma|M_k|^2=\Sigma|\underline{M}_k|^2$. Another simple approach is to force the peak values to be the same, i.e., $\max(\{M_k\})=\max(\{\underline{M}_k\})$. Whatever normalization method is used, the same normalization is applied to the modeled magnitudes at the fixed frequencies.

The K scale factors are then computed as $S_k=M_k/\underline{M}_k$, k=1, 2, . . . , K. If, for some k, $\underline{M}_k=0$, then the corresponding $S_k$ is taken to be 1.0.

At block 122 the scale factors at the modified harmonic frequencies are interpolated to obtain the scale factors at the fixed frequencies. The scale factors at the fixed frequencies (i*π/N), i=0, 1, . . . , N are denoted by $\{T_0, T_1, \ldots, T_N\}$. The values $T_0$ and $T_N$ are set at 1.0. The other values are computed through interpolation of the known values at the modified harmonic frequencies. For example, if i*π/N falls between $\theta_k$ and $\theta_{k+1}$, the scale factor at the $i^{th}$ fixed frequency is given by $$T_i=S_k+[((i*\pi/N)-\theta_k)/(\theta_{k+1}-\theta_k)]*(S_{k+1}-S_k), \text{ for } i=1, 2, \ldots, N-1.$$

At block 124 the spectral envelope is sampled to obtain the modeled magnitudes at the fixed frequencies (i*π/N), i=0, 1, . . . , N. The modeled magnitudes at the fixed frequencies are denoted by $\{\underline{P}_0, \underline{P}_1, \ldots, \underline{P}_N\}$. At block 126 a new set of magnitudes at the fixed frequencies is computed by multiplying the modeled (and normalized) magnitudes at these frequencies with the corresponding scale factors, i.e., $P_1=\underline{P}_i*T_i$, i=0, 1, . . . , N.

Flow then returns to block 112, where an inverse transform is applied to the new set of magnitudes at the fixed frequencies and the predictor coefficients are found at block 114.

When the iterative process is completed, the predictor coefficients obtained at block 114 are the required all-pole model parameters. These parameters can be quantized using well-known techniques. In a corresponding decoder, the modeled harmonic magnitudes are computed by sampling the spectral envelope at the modified harmonic frequencies.

For a given model order, the modeling accuracy generally improves with the number of iterations performed. Most of the gain, however, is realized after a single iteration. The invention provides an all-pole modeling method for representing a set of speech harmonic magnitudes. Through an iterative procedure, the method improves the interpolation curve that is used in the frequency domain. Measured in terms of spectral distortion, the modeling accuracy of this method has been found to be better than earlier known methods.

In the embodiment described above, it is assumed that N>J+1, which is normally the case. The J predictor coefficients $\{a_1, a_2, \ldots, a_J\}$ model the N+1 spectral magnitudes at the fixed frequencies, viz., $\{P_0, P_1, \ldots, P_N\}$, and thereby the K harmonic magnitudes $\{M_1, M_2, \ldots, M_K\}$ with some modeling error. A further embodiment uses a value of J such that K<=J+1. In this embodiment it is possible to model the harmonic magnitudes exactly (within a gain constant) as follows. If K<J+1, some dummy harmonic magnitude values (>=0) are added so that K=J+1. N is chosen as N=K−1=J, and the harmonic frequencies are mapped so that $\omega_1$ is mapped to 0*π/N, $\omega_2$ to 1*π/N, $\omega_3$ to 2*π/N, and so on, and finally $\omega_K$ to (K−1)*π/N=π. In this manner, the harmonic magnitudes $\{M_1, M_2, \ldots, M_K\}$ map exactly on to the set $\{P_0, P_1, \ldots, P_N\}$. At block 112, the set $\{P_0, P_1, \ldots, P_N\}$ is transformed into the set $\{R_0, R_1, \ldots, R_J\}$ by means of the inverse DFT which is invertible. At block 114, the set $\{R_0, R_1, \ldots, R_J\}$ is transformed into the set $\{a_1, a_2, \ldots, a_J\}$ through Levinson-Durbin recursion which is also invertible within a gain constant. Thus the predictor coefficients $\{a_1, a_2, \ldots, a_J\}$ model the harmonic magnitudes $\{M_1, M_2, \ldots, M_K\}$ exactly within a gain constant. No additional iteration is required. There is no modeling error in this case. Any coding, i.e., quantization, of the predictor coefficients may introduce some coding error. To obtain the harmonic magnitudes from the predictor coefficients, the predictor coefficients $\{a_1, a_2, \ldots, a_J\}$ are transformed to $\{R_0, R_1, \ldots,$ $R_J\}$ and then $\{R_0, R_1, \ldots, R_J\}$ is are transformed to $\{P_0, P_1, \ldots, P_N\}$ which is are the same as $\{M_1, M_2, \ldots, M_K\}$ through appropriate inverse transformations.

Figure 2:
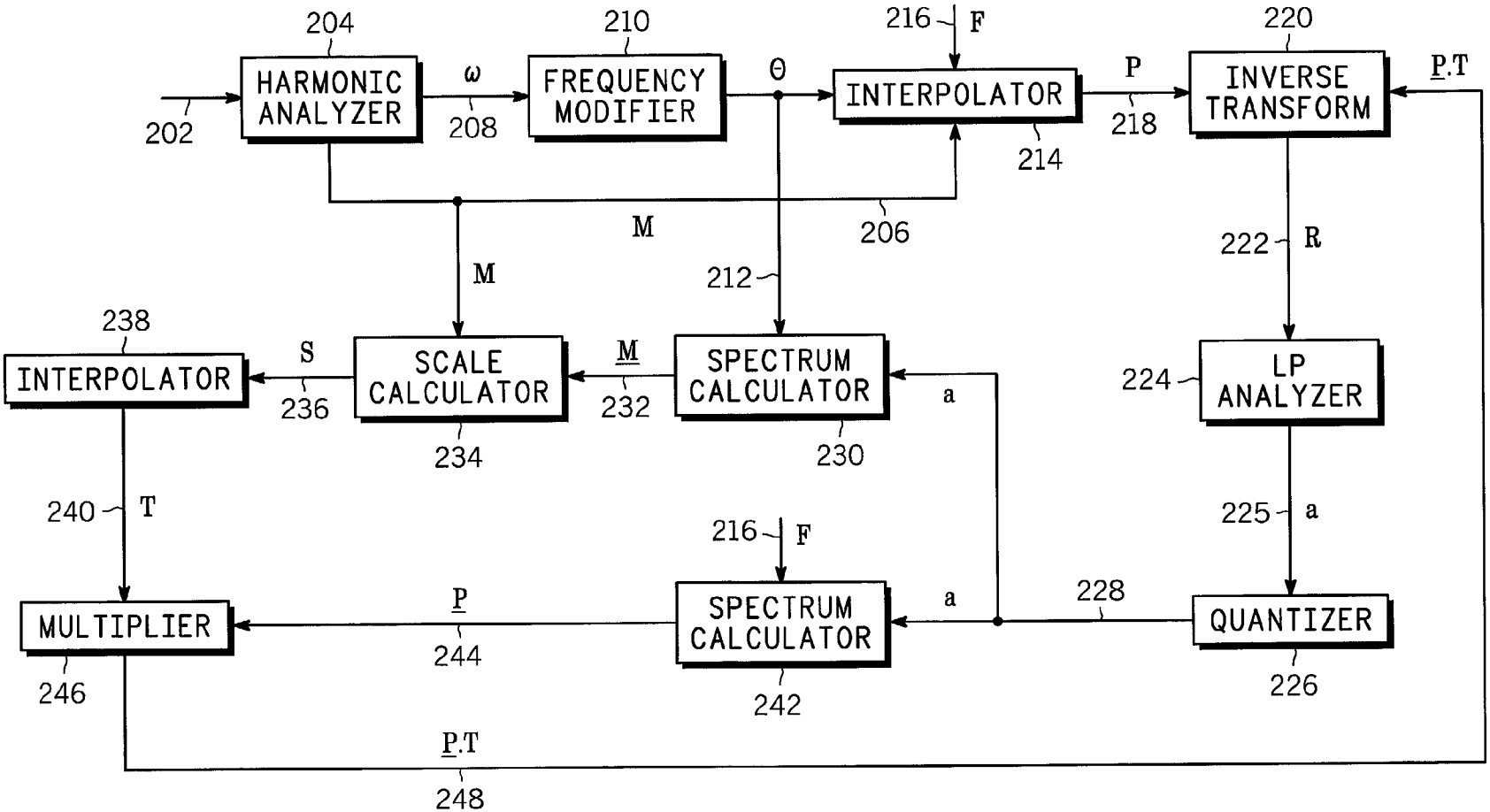
FIG. 2 is a diagrammatic representation of a preferred embodiment of a system for modeling speech harmonic magnitudes in accordance with the present invention.

FIG. 2 shows a preferred embodiment of a system for modeling speech harmonic magnitudes in accordance with an embodiment of the present invention. Referring to FIG. 2, the system has an input 202 for receiving speech frame, and a harmonic analyzer 204 for calculating the harmonic magnitudes 206 and harmonic frequencies 208 of the speech. The harmonic frequencies are transformed in frequency modifier 210 to obtain modified harmonic frequencies 212. The harmonic magnitudes 206 and modified harmonic frequencies 212 are passed to interpolator 214, where the spectral magnitudes at the fixed frequencies $F=\{0, \pi/N, 2\pi/N, \ldots, \pi\}$ (216) are computed. The spectral magnitudes 218 at the fixed frequencies are passed to inverse Fourier transformer 220, where an inverse transform is applied to obtain a pseudo auto-correlation sequence 222. An LP analysis of the pseudo auto-correlation sequence is performed by LP analyzer 224 to yield predictor coefficients 225. The prediction coefficients 225 are passed to a coefficient quantizer or coder 226. This produces the quantized coefficients 228 for output. The quantized prediction coefficients 228 (or the prediction coefficients 225) and the modified harmonic frequencies 212 are supplied to spectrum calculator 230 that calculates the modeled magnitudes 232 at the modified harmonic frequencies by sampling the spectral envelope corresponding to the prediction coefficients.

The final prediction coefficients may be quantized or coded before being stored or transmitted. When the speech signal is recovered by synthesis, the quantized or coded coefficients are used. Accordingly, a quantizer or coder/decoder is applied to the predictor coefficients 225 in a further embodiment. This ensures that the model produced by the quantized coefficients is as accurate as possible.

From the modeled harmonic magnitudes 232 and the actual harmonic magnitudes 206, the scale calculator 234 calculates a set of scale factors 236. The scale calculator also computes a gain value or normalization value as described above with reference to FIG. 1. The scale factors 236 are interpolated by interpolator 238 to the fixed frequencies 216 to give the interpolated scale factors 240.

The quantized prediction coefficients 228 (or the prediction coefficients 225) and the fixed frequencies 216 are also supplied to spectrum calculator 242 that calculates the modeled magnitudes 244 at the fixed frequencies by sampling the spectral envelope.

The modeled magnitudes 244 at the fixed frequencies and the interpolated scale factors 240 are multiplied together in multiplier 246 to yield the product P.T, 248. The product P.T is passed back to inverse transformer 220 so that an iteration may be performed.

When the iteration process is complete, the quantized predictor coefficients 228 are output as model parameters, together with the voicing class, the pitch frequency, and the gain value.

Figure 3:
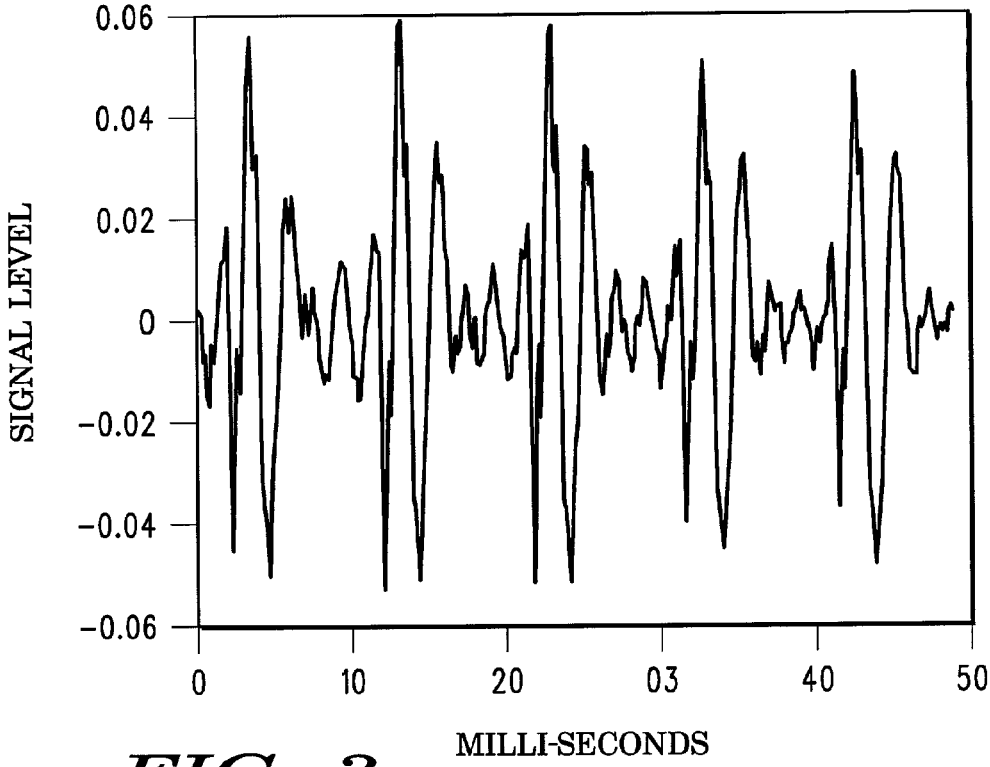
FIG. 3 is a graph of an exemplary speech waveform.
Figure 4:
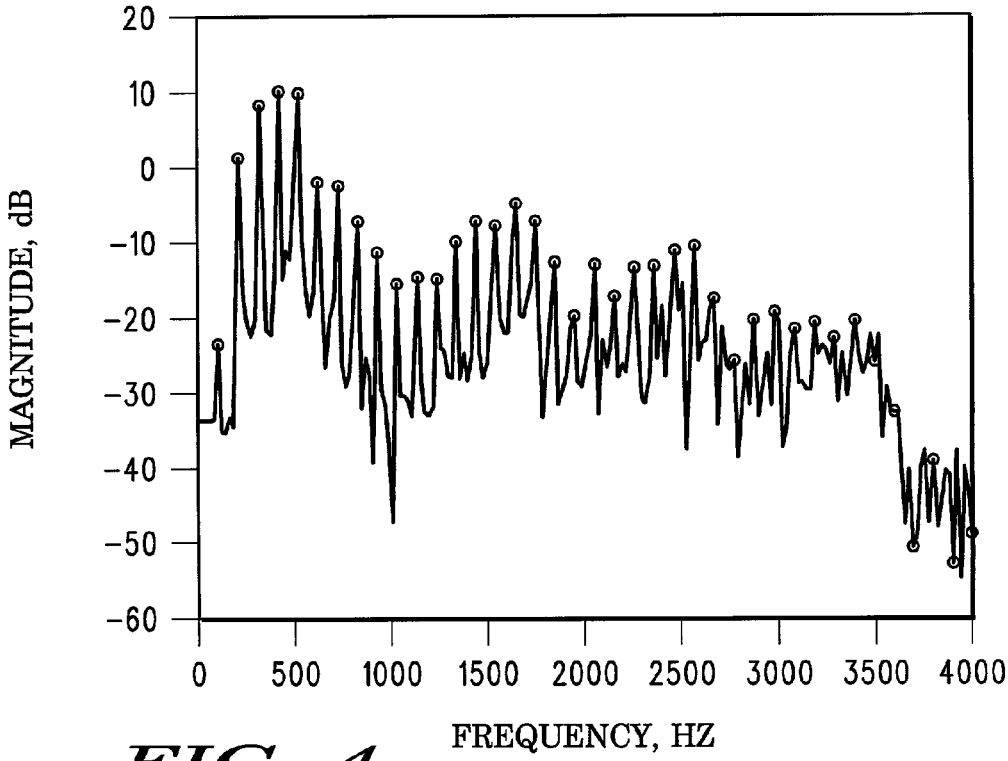
FIG. 4 is a graph of the spectrum of the exemplary speech waveform, showing speech harmonic magnitudes.
Figure 5:
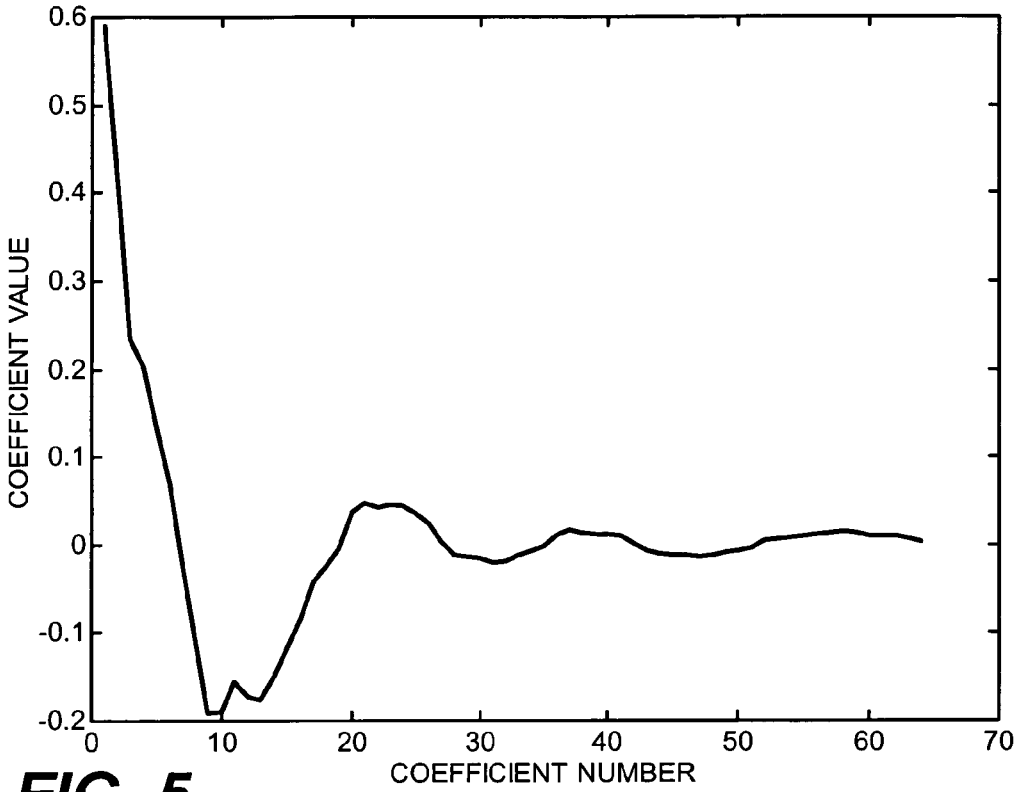
FIG. 5 is a graph of a pseudo auto-correlation sequence in accordance with an aspect of the present invention.
Figure 6:
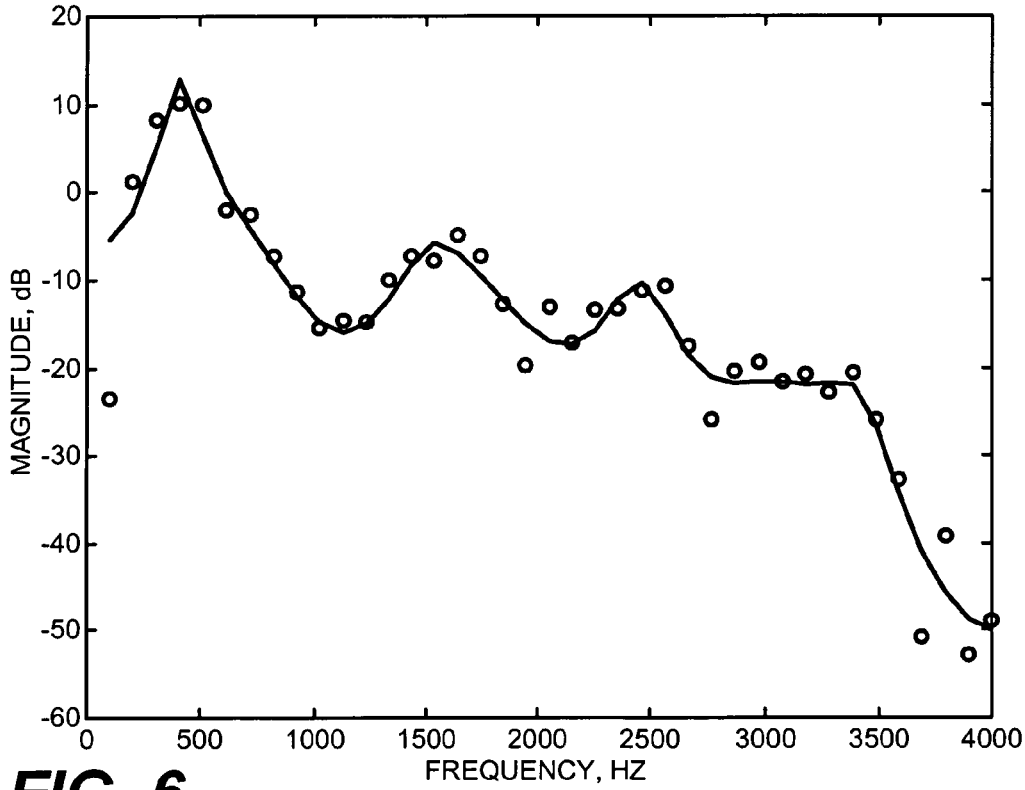
FIG. 6 is a graph of a spectral envelope derived in accordance with the present invention.

FIGS. 3–6 show example results produced by an embodiment of the method of the invention. FIG. 3 is a graph of a speech waveform sampled at 8 kHz. The speech is voiced. FIG. 4 is a graph of the spectral magnitude of the speech waveform. The magnitude is shown in decibels. The harmonic magnitudes are denoted by the circles at the peaks of the spectrum. The circled values are the harmonics magnitudes, M. The pitch frequency is 102.5 Hz. FIG. 5 is a graph of the pseudo auto-correlation sequence, R. N=64 in this example. The predictor coefficients are calculated from R. FIG. 6 is a graph of the spectral envelope at the fixed frequencies, derived from the predictor coefficients after several iterations. The order of the predictor is 14. Also shown in FIG. 6 are circles denoting the harmonic magnitudes, M. It can be seen that the spectral envelope provides a good approximation to the harmonic magnitudes at the harmonic frequencies.

Table 1 shows exemplary results computed using a 3-minute speech database of 32 sentence pairs. The database comprised 4 male and 4 female talkers with 4 sentence pairs each. Only voiced frames are included in the results, since they are the key to good output speech quality. In this example 4258 frames were voiced out of a total of 8726 frames. Each frame was 22.5 ms long. In the table, the present invention (ITT method) is compared with the discrete all-pole modeling (DAP) method for several different model orders.

TABLE 1

Model order Vs. Average distortion (dB).

| | | ITT | | | |
|---|---|---|---|---|---|
| MODEL ORDER | DAP 15 iterations | no-iterations | 1 iteration | 2 iterations | 3 iterations |
| 10 | 3.71 | 3.54 | 3.41 | 3.39 | 3.38 |
| 12 | 3.34 | 3.27 | 3.10 | 3.06 | 3.03 |
| 14 | 2.95 | 2.98 | 2.75 | 2.68 | 2.65 |
| 16 | 2.60 | 2.74 | 2.43 | 2.33 | 2.28 |

The distortion D in dB is calculated as $$D = \frac{1}{N}\sum_{i=1}^{i=N} Di$$

where $$Di = \sqrt{\frac{1}{Ki}\sum_{k=1}^{k=Ki} [20*\log_{10}(M_{k,i}) - 20*\log_{10}(\underline{M}_{k,i})]^2},$$

$M_{k,i}$ is the $k^{th}$ harmonic magnitude of the $i^{th}$ frame, and $\underline{M}_{k,i}$ is the $k^{th}$ modeled magnitude of the $i^{th}$ frame. Both the actual and modeled magnitudes of each frame are first normalized such that their log-mean is zero.

The average distortion is reduced by the iterative method of the present invention. Much of the improvement is obtained after a single iteration.

Those of ordinary skill in the art will recognize that the present invention could be implemented as software running on a processor or by using hardware component equivalents such as special purpose hardware and/or dedicated processors, which are equivalents to the invention as described and claimed. Similarly, general purpose computers, microprocessor based computers, digital signal processors, microcontrollers, dedicated processors, custom circuits, ASICS and/or dedicated hard wired logic may be used to construct alternative equivalent embodiments of the present invention.

While the invention has been particularly shown and described with reference to a preferred embodiment, it will be understood by those skilled in the art that various changes in form and detail may be made therein without departing from the spirit and scope of the invention. In particular, the invention may be used to model tonal signals for sources other than speech. The frequency components of the tonal signals need not be harmonically related, but may be unevenly spaced.

While the invention has been described in conjunction with specific embodiments, it is evident that many alternatives, modifications, permutations and variations will become apparent to those of ordinary skill in the art in light of the foregoing description. Accordingly, it is intended that the present invention embrace all such alternatives, modifications and variations as fall within the scope of the appended claims.

The invention claimed is:

1. A system of modeling a signal in accordance with a computer program stored in at least one of a memory, an application specific integrated circuit, a digital signal processor and a field programmable gate array, comprising:

a) an input for receiving the signal;

b) a harmonic analyzer operable to identify a plurality of harmonic magnitudes and a plurality of harmonic frequencies of the signal;

c) a first interpolator, responsive to the plurality of harmonic magnitudes and operable to produce a first plurality of spectral magnitudes at a set of fixed frequencies;

d) an inverse transformer, responsive to the first plurality of spectral magnitudes or to a next plurality of spectral magnitudes and operable to produce a pseudo auto-correlation sequence therefrom;

e) a linear prediction analyzer, operable to calculate a set of linear prediction coefficients from the pseudo auto-correlation sequence;

f) a first spectrum calculator, responsive to the set of linear prediction coefficients and operable to produce a plurality of model harmonic magnitudes therefrom;

g) a scale calculator operable to calculate a first set of scale factors as the ratio of the harmonic magnitudes to the model harmonic magnitudes;

h) a second interpolator, operable to interpolate the first set of scale factors to obtain a second set of scale factors at the set of fixed frequencies;

i) a second spectrum calculator, operable to calculate model spectral magnitudes at the set of fixed frequencies by sampling the spectral envelope defined by the linear prediction coefficients at the set of fixed frequencies;

j) a multiplier, operable to multiply the model spectral magnitudes at the set of fixed frequencies by the second set of scale factors to obtain the next plurality of spectral magnitudes; and k) an output for outputting the linear prediction coefficients, wherein the inverse transformer is operable to inverse transform the next plurality of spectral macinitudes to obtain a new pseudo auto-correlation sequence and wherein the linear prediction analyzer is operable to calculate new linear prediction coefficients from the new pseudo auto-correlation sequence and wherein the signal is modeled by the new linear prediction coefficients.

2. A system in accordance with claim 1, further comprising a frequency modifier, operable to modify the plurality of harmonic frequencies to produce a plurality of modified harmonic frequencies.

3. A system in accordance with claim 1, further comprising a quantizer, operable to quantize the linear prediction coefficients.

4. A device for modeling a signal, wherein the device is directed by a computer program stored in at least one of a memory, an application specific integrated circuit, a digital signal processor and a field programmable gate array, wherein the computer program is operable to:

a) identify a plurality of harmonic frequencies;

b) identify a plurality of harmonic magnitudes corresponding to spectral magnitudes of the signal at the plurality of harmonic frequencies;

c) interpolate the plurality of harmonic magnitudes to obtain a plurality of spectral magnitudes at a set of fixed frequencies;

d) inverse transform the plurality of spectral magnitudes to obtain a pseudo auto-correlation sequence;

e) calculate linear prediction coefficients from the pseudo auto-correlation sequence;

f) calculate model harmonic magnitudes by sampling a spectral envelope defined by the linear prediction coefficients;

g) calculate a first set of scale factors as the ratio of the harmonic magnitudes to the model harmonic magnitudes;

h) interpolate the first set of scale factors to obtain a second set of scale factors at the set of fixed frequencies;

i) calculate model spectral magnitudes at the set of fixed frequencies by sampling the spectral envelope defined by the linear prediction coefficients at the set of fixed frequencies;

j) multiply the model spectral magnitudes at the set of fixed frequencies by the second set of scale factors to obtain a new plurality of spectral magnitudes;

k) inverse transform the new plurality of spectral magnitudes to obtain a new pseudo auto-correlation sequence; and l) calculate new linear prediction coefficients from the new pseudo auto-correlation sequence, and wherein the signal is modeled by the new linear prediction coefficients.

5. A device in accordance with claim 4, wherein the computer program is further operable to repeat f) through I) at least once.

6. A device in accordance with claim 4, wherein the computer program is further operable to modify the plurality of harmonic frequencies to obtain a plurality of modified harmonic frequencies, and to calculate the plurality of spectral magnitudes at a set of fixed frequencies by interpolating from the plurality of modified harmonic frequencies to the set of fixed frequencies.

7. A device in accordance with claim 4, wherein the set of fixed frequencies includes frequencies outside of the plurality of harmonic frequencies, and wherein the computer program is further operable to calculate spectral magnitudes at frequencies outside of the plurality of harmonic frequencies by extrapolating from the plurality of harmonic frequencies.

8. A device in accordance with claim 4, wherein the computer program is operable to calculate the linear prediction coefficients using Levinson Durbin recursion.

9. A device in accordance with claim 4, wherein the computer program is further operable to model the signal by a voicing class, a pitch frequency, and a gain value.

10. A device in accordance with claim 4, wherein the computer program is operable to quantize the linear prediction coefficients to obtain quantized linear prediction coefficients.

11. A device in accordance with claim 10, wherein the computer program is operable to calculate the model harmonic magnitudes and the model spectral magnitudes from the quantized linear prediction coefficients.

12. A device in accordance with claim 4, wherein the device is operable to receive a speech signal and the computer program is operable to encode the speech signal using the linear prediction coefficients.

13. A device in accordance with claim 4, wherein the plurality of harmonic frequencies are evenly spaced.

14. A device in accordance with claim 4, wherein the plurality of harmonic frequencies are not evenly spaced.

15. A device in accordance with claim 4, wherein the inverse transform is an inverse fast Fourier transform.

16. A device in accordance with claim 4, wherein the inverse transform is an inverse discrete Fourier transform.

17. A device in accordance with claim 4, wherein the model harmonic magnitudes are normalized to have the same sum of squares as the plurality of harmonic magnitudes.

18. A device in accordance with claim 4, wherein the model harmonic magnitudes are normalized to have the same peak value as the plurality of harmonic magnitudes.

19. A device in accordance with claim 4, wherein interpolating the plurality of harmonic magnitudes to obtain a plurality of spectral magnitudes at a set of fixed frequencies uses linear interpolation.

20. A device in accordance with claim 4, wherein interpolating the plurality of harmonic magnitudes to obtain a plurality of spectral magnitudes at a set of fixed frequencies uses non-linear interpolation.

21. A device in accordance with claim 4, wherein interpolating the first set of scale factors to obtain a second set of scale factors at the set of fixed frequencies uses linear interpolation.

22. A device in accordance with claim 4, wherein interpolating the first set of scale factors to obtain a second set of scale factors at the set of fixed frequencies uses non-linear interpolation.

23. A device in accordance with claim 4, wherein the computer program is further operable to:

calculate a modified plurality of spectral magnitudes at a set of fixed frequencies by applying a modifying function to the plurality of spectral magnitudes at a set of fixed frequencies; and to calculate model harmonic magnitudes by sampling a spectral envelope defined by the linear prediction coefficients and applying an inverse of the modifying function.

24. A device in accordance with claim 23, wherein the modifying function is a logarithm function.

25. A device in accordance with claim 23, wherein the modifying function is a power function.

26. A computer readable medium containing instructions which, when operated on a computer, carry out a process of modeling a plurality of harmonic magnitudes at a plurality of harmonic frequencies, the process comprising:

a) interpolating the plurality of harmonic magnitudes to obtain a plurality of spectral magnitudes at a set of fixed frequencies;

b) inverse transforming the plurality of spectral magnitudes to obtain a pseudo auto-correlation sequence;

c) calculating linear prediction coefficients from the pseudo auto-correlation sequence;

d) calculating model harmonic magnitudes by sampling a spectral envelope defined by the linear prediction coefficients;

e) calculating a first set of scale factors as the ratio of the harmonic magnitudes to the model harmonic magnitudes;

f) interpolating the first set of scale factors to obtain a second set of scale factors at the set of fixed frequencies;

g) calculating model spectral magnitudes at the set of fixed frequencies by sampling the spectral envelope defined by the linear prediction coefficients at the set of fixed frequencies;

h) multiplying the model spectral magnitudes at the set of fixed frequencies by the second set of scale factors to obtain a new plurality of spectral magnitudes;

i) inverse transforming the new plurality of spectral magnitudes to obtain a new pseudo auto-correlation sequence; and j) calculating new linear prediction coefficients from the new pseudo auto-correlation sequence, wherein the signal is modeled by the new linear prediction coefficients.

27. A computer readable medium in accordance with claim 26, wherein said process further comprises repeating d) through j) at least once.

28. A computer readable medium in accordance with claim 26, wherein said process further comprises modifying the plurality of harmonic frequencies to obtain a plurality of modified harmonic frequencies, and wherein the plurality of spectral magnitudes at a set of fixed frequencies is calculated by interpolating from the plurality of modified harmonic frequencies to the set of fixed frequencies.

29. A computer readable medium in accordance with claim 26, wherein the set of fixed frequencies includes frequencies outside of the plurality of harmonic frequencies, and wherein said process further comprises calculating spectral magnitudes at frequencies outside of the plurality of harmonic frequencies by extrapolating from the plurality of harmonic frequencies.

30. A computer readable medium in accordance with claim 26, wherein the linear prediction coefficients are calculated using Levinson-Durbin recursion.

31. A computer readable medium in accordance with claim 26, wherein the signal is further modeled by a voicing class, a pitch frequency, and a gain value.

32. A computer readable medium in accordance with claim 26, wherein the inverse transform is one of an inverse fast Fourier transform and an inverse discrete Fourier transform.

33. A computer readable medium in accordance with claim 26, wherein the linear prediction coefficients are quantized to obtain quantized linear prediction coefficients.

34. A computer readable medium in accordance with claim 33, wherein the model harmonic magnitudes and the model spectral magnitudes are calculated from the quantized linear prediction coefficients.

35. A computer readable medium in accordance with claim 26, wherein the model harmonic magnitudes are normalized to have one of 1) the same sum of squares as the plurality of harmonic magnitudes and 2) the same peak value as the plurality of harmonic magnitudes.

36. A computer readable medium in accordance with claim 26, wherein interpolating the plurality of harmonic magnitudes to obtain a plurality of spectral magnitudes at a set of fixed frequencies uses one of linear interpolation and non-linear interpolation.

37. A computer readable medium in accordance with claim 26, wherein interpolating the first set of scale factors to obtain a second set of scale factors at the set of fixed frequencies uses one of linear interpolation and non-linear interpolation.

38. A computer readable medium in accordance with claim 26, wherein the process further comprises:

calculating a modified plurality of spectral magnitudes at a set of fixed frequencies by applying a modifying function to the plurality of spectral magnitudes at a set of fixed frequencies; and calculating model harmonic magnitudes by sampling a spectral envelope defined by the linear prediction coefficients and applying an inverse of the modifying function.

39. A computer readable medium in accordance with claim 38, wherein the modifying function is one of a logarithm function and a power function.

* * * * *